166-66 SR

10/9/84 XR 4,475,591

United States Patent [19]

Cooke, Jr.

[11] Patent Number: 4,475,591

[45] Date of Patent: Oct. 9, 1984

[54] METHOD FOR MONITORING SUBTERRANEAN FLUID COMMUNICATION AND MIGRATION

[75] Inventor: Claude E. Cooke, Jr., Houston, Tex.

[73] Assignee: Exxon Production Research Co., Houston, Tex.

[21] Appl. No.: 405,964

[22] Filed: Aug. 6, 1982

[51] Int. Cl.[3] ..... E21B 47/06

[52] U.S. Cl. ..... 166/254; 73/155; 166/66

[58] Field of Search ..... 166/250, 253, 254, 66; 73/155; 33/302, 306, 307

[56] References Cited

U.S. PATENT DOCUMENTS

| | | | |
|---|---|---|---|
| 3,055,428 | 9/1962 | Buck et al. | 166/250 |
| 3,376,921 | 4/1968 | Manry et al. | 166/250 |
| 3,489,219 | 1/1970 | Higgins | 166/253 |
| 3,734,182 | 5/1973 | Warren et al. | 166/254 |
| 3,908,761 | 9/1975 | Patterson et al. | 166/250 |
| 4,109,717 | 8/1978 | Cooke, Jr. | 166/250 |
| 4,120,166 | 10/1978 | Brooks, Jr. | 166/253 |
| 4,191,250 | 3/1980 | Messenger | 166/253 |
| 4,224,988 | 9/1980 | Gibson et al. | 73/155 |
| 4,279,299 | 7/1981 | Shuck | 166/250 |
| 4,326,411 | 4/1982 | Gant et al. | 73/155 |

OTHER PUBLICATIONS

Pressure Transient, Article by Henry J. Ramey, Jr.; Jul. 1982; Journal of Petroleum Technology.

"Pressure in a Well Annulus After Cementing"; Kuksov, A. R. et al.; Neflyance Khozyaistvo, No. 10, pp. 26–30, 1971.

"Measurement of Pressure and Temperature for the Cemented Annular Space of a Well", Vidovskii, A. L. et al., Bureniye, No. 7, pp. 36–39, 1974.

*Primary Examiner*—Stephen J. Novosad
*Assistant Examiner*—William P. Neuder
*Attorney, Agent, or Firm*—Richard F. Phillips

[57] ABSTRACT

A method is detailed for obtaining data useful in the analysis of fluid communication and migration between first and second horizons intersected by a wellbore. In the practice of this method, a pressure transducer is fixedly attached to a length of casing. The casing is inserted into the well such that the transducer is positioned proximate the first horizon. The annulus between the face of the wellbore and the casing is then filled with cement and the cement is permitted to cure. The output of the transducer is monitored and recorded. A change in the pressure observed at the first horizon corresponding to a known change in the pressure at the second horizon is indicative of fluid communication between the two horizons. The change in the pressure condition of the second interval can be induced artificially by the injection of fluids into the second interval or by the production of pore fluids from the second interval.

17 Claims, 4 Drawing Figures

METHOD FOR MONITORING SUBTERRANEAN FLUID COMMUNICATION AND MIGRATION

DESCRIPTION

TECHNICAL FIELD

This invention is directed generally toward the measurement of subterranean conditions. More specifically, this invention concerns a method involving at least one pressure transducer positioned in the cemented annulus external to the casing of a well for monitoring subterranean fluid communication, fluid migration, and rock properties.

BACKGROUND OF THE INVENTION

In the completion of wells drilled in the course of the exploration for and production of oil and natural gas, the borehole is typically cased and cemented. This generally occurs in several stages. An initial section of the well is drilled with a large diameter bit and into this section large diameter casing is set. This initial length of casing is termed "surface casing". The annulus intermediate the borehole and the surface casing is then filled with cement. Following this, a smaller diameter drill string is passed through the initial section of casing and an additional section of the well is drilled and then cased and cemented. This process continues, often through three or more stages, until the desired depth has been attained.

A prime reason for utilizing cemented casing in the completion of a well is to isolate from fluid communication with one another the various strata or horizons through which the borehole passes. Absent this step a number of undesirable situations could arise due to this fluid communication; among these are that valuable hydrocarbons could be lost from a high pressure reservoir stratum to a lower pressure "thief" stratum and it could be difficult to direct formation treatments to a selected stratum. The cemented casing also serves to provide structural support to the wellbore to prevent the collapse of any portion of the formation into the wellbore.

After having set the casing, it is necessary to provide for fluid communication between the wellhead and one or more of the subterranean strata. In most instances this is accomplished by a technique known as perforation, in which a series of holes are formed through the casing and cement into the desired stratum. Through these perforations oil and gas can pass from the reservoir to production tubing. Also, fluids can be injected into the stratum through the perforations in the process of stimulating the production of oil and gas.

One of the most common and long standing problems associated with the completion of oil and gas wells is the occurrence of fluid communication between various otherwise isolated strata. This is generally caused by leakage along the cemented annulus due to the cement not forming a perfect seal between the wellbore and the casing. This can cause the loss of hydrocarbons from the reservoir, decrease the effectiveness of stimulation treatments such as formation fracturing and acidizing, and prevent injected drive fluids such as water and carbon dioxide from displacing oil and gas in an efficient manner. In some such situations, the existence of this fluid communication between otherwise isolated strata in a well can result in the loss of very significant sums of money.

The cause of fluid communication between strata where none existed prior to the drilling of the well is most often the result of an imperfect cement job. Less often, however, this problem is the result of fracturing of the formation in the course of drilling or treating the well.

In the cementing process, cement is pumped through the casing to the bottom of the cased portion of the borehole, where it passes into the annulus between the casing and the wellbore. As pumping is continued, it is desired that cement should fill the annulus and cause the drilling mud to be displaced upward and out of the annulus. However, in this process some of the mud may not be displaced, leaving passageways or channels in the cemented annulus through which fluids can readily flow. This is called "channeling". It is also believed that a too-rapid loss of pressure in the cemented annulus during curing of the cement can result in reduced resistance of the cement to fluid flow. Even though the utmost care may be taken, the resulting cement job can still be imperfect on occasion. Remedial cementing, often termed "cement squeezing", is utilized to introduce cement into channeled regions of the annulus following the initial cementation of the annulus. Such cement repair operations are expensive and are not always successful.

One of the most troublesome aspects of fluid communication along the annulus is the difficulty that has been experienced heretofore in detecting it. Most traditional methods of making measurements in wells rely on logging. In well logging, a condition monitoring assembly, termed a "sonde", is lowered into a case or open wellbore at the end of a wireline and measurements of one or more features of the well and its surroundings are made as a function of depth. A major drawback in the use of cased hole logging for monitoring a condition external to the casing, such as fluid flow within the annulus, is that the existence and magnitude of such conditions can in most instances only be inferred, and not measured directly. For example, common techniques for monitoring flow along the annulus include the taking of temperature and noise logs. From data so obtained the existence of fluid passage through the annulus can in many instances be discovered from anomolous temperature gradients and noise shown by the log. However, such techniques are expensive, often don't provide definitive data and generally require other operations on the well to cease during the time of logging. Further, these cased hole logging techniques are largely insensitive to fluid flow between strata by a pathway other than through the annulus.

The most common direct technique for monitoring fluid flow along the annulus involves the injection of a radioactive tracer into the horizon of interest through perforations in the casing. A gamma-ray log is then run to detect any passage of fluid from the horizon into which the injection took place to other regions along the wellbore. This method is disadvantageous in that it is rather insensitive to the detection of fluid communication other than along the annulus. Further, this technique requires the use of a radioactive material.

Still another method for determining the existence of fluid flow between strata relies upon pressure measurements. The completion of a well generally requires that the various producing horizons within the formation be perforated and connected to the surface in fluid isolation from the remainder of the producing formations through a tubing and packer system. Thus, each potential hydrocarbon bearing horizon may be produced and treated individually. By monitoring the pressure in the tubing system associated with each perforated horizon, information regarding fluid flow away from or into each horizon can be inferred. This method is disadvantageous in that only those strata in fluid communication with the surface can be monitored. An additional disadvantage is that monitoring formation pressure through a production string generally requires the cessation of production or treatment on the formation for which the pressure measurement is being made.

It would be desirable to provide a simple and accurate method for monitoring a well for fluid communication along the wellbore between strata intersected by the wellbore. It is further desirable that such a system be adapted to provide fluid communication monitoring continuously and in such a manner that production and formation treating operations may be carried on simultaneously with the monitoring. It is also desirable that such a system not be dependent upon the existence of fluid communication between the strata of interest and the interior of the casing.

SUMMARY OF THE INVENTION

A method is set forth which serves to provide data useful in determining the occurrence of fluid communication between various horizons intersected by a well. This determination can be made irrespective of whether the communication occurs longitudinally along the borehole or by means of natural or artificial flow paths, such as fractures, extending between the horizons at a spaced distance from the borehole. No interruption or production from or injection into the well is required in the practice of this invention. This method is especially well adapted for long term measurements and for use in the application of pressure transient flow theory to obtain quantitative information concerning those formation properties relating to fluid flow and communication through the stratum of interest.

A preferred embodiment of the present invention encompasses a method for completing and monitoring a well to yield data useful in detecting the existence of fluid communication between a first and a second interval along a cased wellbore, the first and second intervals being a spaced longitudinal distance apart. A first pressure transducer is positioned within the uncemented wellbore annulus proximate the first interval. The annulus is cemented and the cement is allowed to cure. The first pressure transducer is monitored in response to the occurrence of an alteration in the pressure condition of the second interval. Subsequently, any correlation between the alteration of the pressure condition at the second interval and the output of the first pressure transducer can be analyzed.

In an alternative embodiment of the present invention, a method is provided for yielding data useful in the interference testing of a permeable horizon. A first pressure transducer is positioned within the uncemented annulus of a first wellbore at a position proximate said permeable horizon. The first pressure transducer is then blanketed with cement pumped into place within the annulus and the cement is allowed to cure. A change in the pressure of the permeable horizon is induced at a second wellbore positioned at a spaced distance from said first wellbore. This pressure change can be induced either by the injection of a fluid through the second wellbore into the permeable horizon or by producing fluid from the permeable horizon through the second wellbore. The first pressure transducer is then monitored and data are obtained, whereby correlations between the pressure change at the second wellbore and the pressure at the first wellbore can be derived.

Existing methods of determining fluid flow and communication between two strata traversed by a wellbore, either through the annulus or through formation fractures, are cumbersome, expensive and time consuming. These methods typically either require that fluid communication exist between the areas of interest and the interior of the casing or depend on indirect techniques such as measuring temperature and noise anomalies along the casing resulting from the induced flow. The present invention overcomes these problems through the use of apparatus for continuously monitoring the formation pressure at selected points outside the casing. The use of the present invention does not interfere with production and with well treatment operations.

As set forth in greater detail subsequently, in cement that has curved within the annulus of a cased well, the fluid pressure within the cement is a function of the fluid pressure in the strata in contact with the cement. It has been discovered that for a fluid pressure type pressure transducer positioned within an unchanneled annulus separating the face of a permeable horizon from the casing within the wellbore, the pressure indicated by the pressure transducer is substantially the same as that of the adjacent horizon. Where the annulus is channeled, the transducer will indicate a pressure substantially equal to that of the fluid within the channel. It has been further discovered that in the pressure injection of fluids into a selected horizon, leakage of the injected fluid away from the selected horizon through the annulus will be indicated by an increase in the reading of a pressure sensor positioned a spaced longitudinal distance away from the perforations.

BRIEF DESCRIPTION OF THE DRAWINGS

For a better understanding of the present invention, reference may be had to the accompanying drawings, in which.

These figures are provided solely for the purpose of demonstrating and explaining a preferred embodiment of the present invention. The figures are not intended to define or limit the invention in any manner.

DESCRIPTION OF THE PREFERRED EMBODIMENTS

The present invention is primarily useful as a method for yielding data of use in determining the existence and magnitude of fluid communication between two strata in a formation traversed by a wellbore. The present invention is alternatively useful as a method for determining the properties relating to fluid flow of a given stratum extending between two wells. As will be set forth below, the method of the preferred embodiment is specifically adapted for use in wells utilized in the production of hydrocarbons. However, it is emphasized that the present invention is generally useful in a wide variety of applications for monitoring the properties between two points in a subterranean formation intersected by a wellbore having a cemented portion. Thus, the present invention may be utilized in conjunction with geothermal energy production wells, water wells, injection wells, and storage wells.

Figure 1:
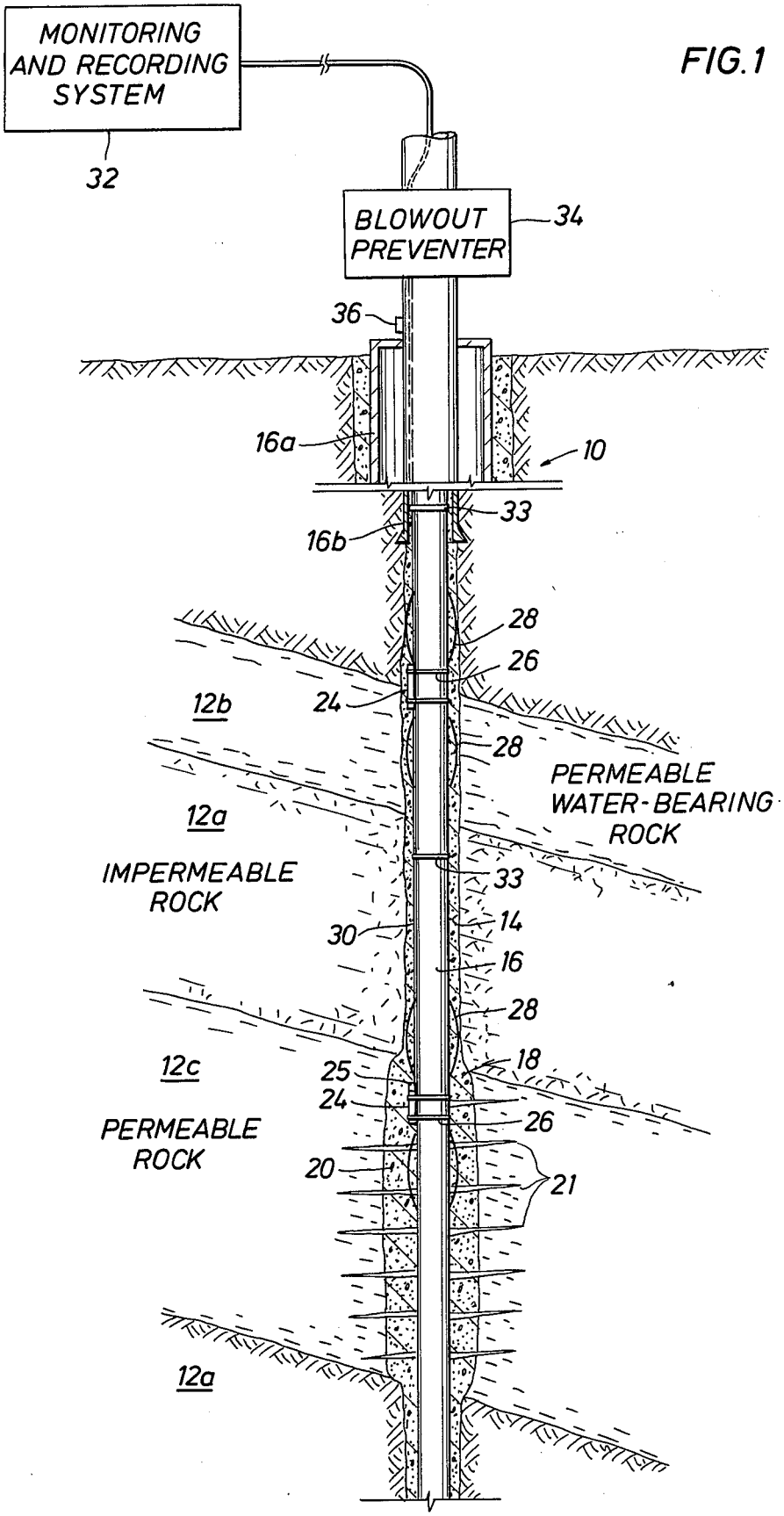
FIG. 1 shows a cross-sectional, diagrammatic view of a well incorporating apparatus adapted and positioned for practicing a preferred embodiment of the method of the present invention.

FIG. 1 sets forth an apparatus situated to perform a preferred embodiment of the present invention. A well, designated by the reference numeral 10, extends into the earth through a series of strata or horizons 12. As shown in FIG. 1, the well may extend through several substantially impermeable, tight strata 12*a*, such as shale or anhydride, a permeable, water-bearing stratum 12*b*, and a permeable hydrocarbon-bearing reservoir horizon 12*c*.

The well 10 is defined by a borehole 14. Positioned within the borehole is casing 16 including surface casing 16*a* and intermediate casing 16*b*. The casing 16 and borehole 14 define an annulus 18 generally concentric with the casing 16. As will be described in greater detail subsequently, the annulus 18 is filled with cement 20 in the process of completing the well 10.

To provide fluid communication between a given stratum 12 and the interior of the casing 16, the casing 16 is perforated at a position adjacent the stratum of interest. This operation yields a series of holes, termed "perforations" 21, passing through the casing 16 and cemented annulus 18 into the stratum of interest 12. In a multiple completion, where more than one stratum 12 is to be perforated, each set of perforations 21 is individually connected through tubing and packers (not shown) to a wellhead 22 (FIG. 2) at the surface.

Attached to the outer face of the casing 16 is at least one pressure transducer 24. A pressure transducer suitable for this application is manufactured by Lynes, Inc. of Houston, Texas, and is marketed under the trade name "Sentry". This instrument is of the type commonly referred to as a "Bourdon tube" pressure sensor. Transducers of other types adapted for the measure of pressure, such as strain gauge transducers, would also be suitable. It is preferable that the transducer utilized require a minimum of volume displacement in the course of its operation. This use of a pressure transducer requiring minimal fluid displacement provides a relatively swift response to changes in the pressure of the current pore fluid. The pressure transducer 24 preferably monitors the pressure at a point in the annulus 18 spaced several centimeters from the outer surface of the casing 16. Thus, the pressure transducer 24 preferably is so situated that the portion of the transducer 24 sensitive to pressure is blanketed by the surrounding cement. The transducer 24 should be sensitive to pressures in the range of from about 0–13.7 MPa (0–20,000 psi).

The cement utilized in well completions is to some degree porous and permeable subsequent to the curing process. A pressure sensor 24 of the type detailed can be utilized to detect the pressure of the fluid within the pores of the cement. This pressure will henceforth be termed the "cement pore pressure". Where the cemented annulus 18 is adjacent a permeable formation 12*c*, the cement pore pressure will, upon equilibrium, be substantially equal to that of the adjacent formation. Hence, the pressure transducer 24 serves to detect the pressure of the fluids in the adjacent formation even though it is embedded in cement 20. However, where there is channeling or a microannulus passing through the cement 20 the pressure detected by the pressure transducer 24 will be affected by the pressure of the fluid within the channel or microannulus. As will be shown subsequently, these properties can be utilized in determining the existence and, in many instances, the general pathway of fluid communication between strata traversed by the well 10.

Extending from the surface to the pressure transducers 24 is a series of conductors 30 permitting the output of the pressure transducers 24 to be monitored at the surface. Preferably, a seven-conductor logging cable 30 is utilized for this purpose. The cable 30 is affixed to the casing 16 by bands 33 to prevent damage to the cable 30 during placement of the casing 16. Proximate each of the transducers 24, a unique one of the conductors of the cable 30 is connected to the transducer 24. Alternatively, a single conductor can be utilized for more than one of the transducers 24, with the outputs from the several pressure transducers 24 being multiplexed.

For those applications in which it is desirable to position the pressure transducer 24 at an interval which is to be perforated, it is advantageous to place a gamma-ray source 25 proximate the transducer 24. This permits the precise vertical and radical position of the transducer 24 to be established prior to perforation. Thus, well known techniques of directional perforation can be utilized to avoid accidental destruction of the transducer 24 or the cable 30.

A plurality of clamps 26 are utilized to secure each transducer 24 to the casing 16. Also attached to the casing 16 and positioned immediately above and below each transducer 24 are a pair of centralizers 28. These centralizers 28 minimize damage to the transducers 24 and cable 30 during running in of the casing 16 and also serve to ensure that the transducer 24 is positioned a spaced distance from the face of the borehole 14 during cementing of the casing 16.

It will be recognized that the monitoring cable 30, being positioned exterior to the casing 16, will necessitate altered procedures in running the casing 16 into the well 10. The use of slips (not shown) with a groove cut therein for the accomodation of the cable 30 has been found useful to prevent damage to the cable 30.

The cable 30 is connected to a monitoring and recording system 32 at the surface. This permits continuous monitoring and recording of the output of the transducers 24. Preferably, the recorder 32 yields a display or chart which can be a log of side-by-side representations of pressure as a function of time for each of the several transducers 24. This log is utilized in determining the existence of fluid communication between strata, as will be detailed subsequently. Alternatively, the display can be a listing of the pressure observed for a given transducer 24 at each of a plurality of times. The display can be either transient, as on an optical viewing screen, or permanent, as by means of a strip chart recorder.

Following the affixation of the transducers 24 and cable 30 to the outer face of the casing 16, and the positioning of the casing 16 within the borehole 14, the annulus 18 is cemented in a manner well familiar to those skilled in the the art. Accordingly, each of the transducers 24 is fixedly positioned within the cement 20 at a preselected position in the borehole 14.

After cementing, the cable 30 is cut at a point a short distance above the blow-out preventer 34 (FIG. 1) and is threaded back down through the blow-out preventer 34 to a valved side-outlet 36 on the A-section of the wellhead. The valved side-outlet 36 is provided with appropriate seals (not shown) to prevent any leakage along the cable 30. The cable 30 is then attached to the recorder 32. During those times when the transducers 24 are not being monitored, that portion of the cable 30 extending outside the wellhead 22 can be disconnected from the recorder 32 and enclosed in a closed metal conduit (not shown) which can be affixed to the wellhead 22.

Figure 3:
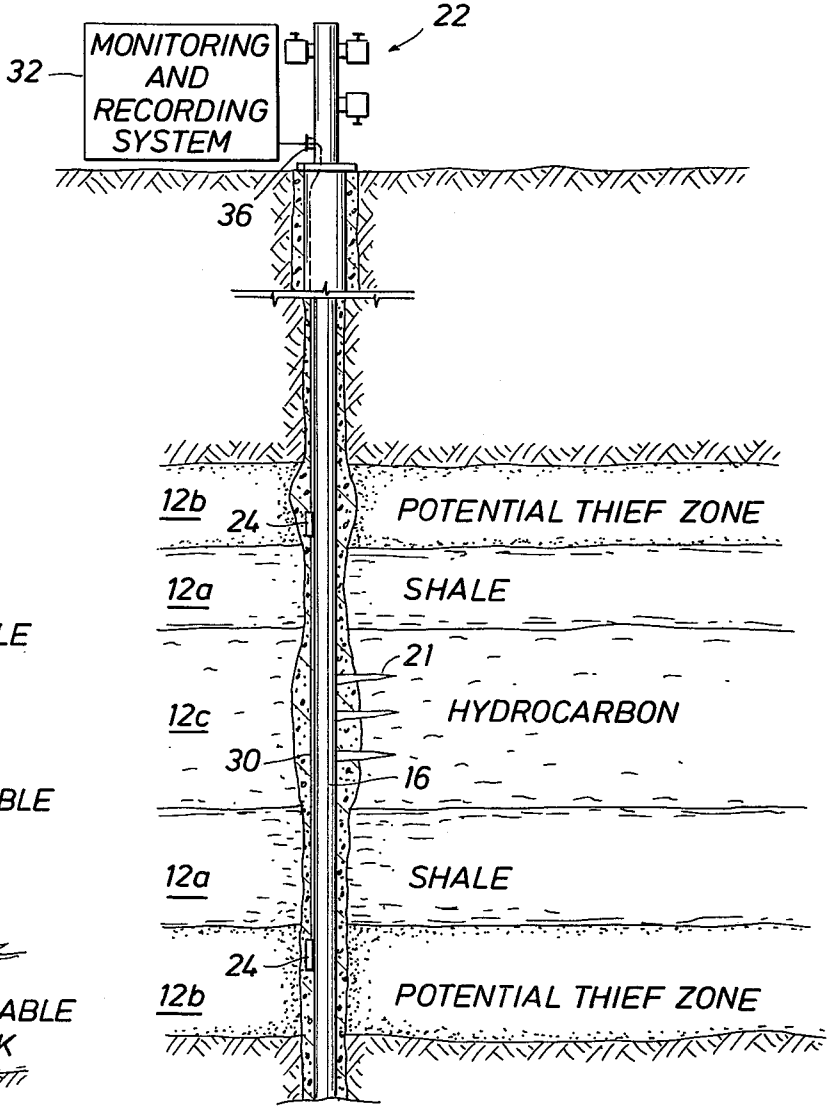
FIG. 3 shows a cross-sectional, diagrammatic view of a well incorporating apparatus adapted and positioned for practicing a further embodiment of the method of the present invention.

In the practice of the present invention it is important that the pressure transducer(s) 24 be positioned at a point in the wellbore 14 appropriate for yielding the desired data. In one application of the present invention, generally indicated in FIG. 3, it is desired to establish whether any portion of a treating or fracturing fluid being injected into a perforated interval 12*c* is flowing to some other stratum. Such diversion of the treating or fracturing fluid is typically caused by fractures in the formation or channels in the cement. To determine whether such flow to other strata is occurring, pressure transducers 24 are attached at a position on the production casing 16 corresponding to a suspected thief zone 12*b*. If there are a plurality of potential thief zones 12*b* it is preferable to affix pressure transducers 24 to points on the casing 16 corresponding to the first potential thief zone 12*b* above and below the perforated interval. Upon commencement of fluid injection into the perforated interval 12*c*, the output of the pressure transducers 24 is monitored. An increase in the pressure in the cemented interval proximate any of the potential thief zones 12*b* indicates flow of some portion of the fluid being injected to that potential thief zone 12*b*.

This application of the present invention can also be utilized in monitoring for the loss of injected fluids in injection wells. Such monitoring is especially important in this instance since many of the fluids utilized—for example, carbon dioxide, enriched hydrocarbon gas, alcohol, steam and surfactants—are injected in quantities having a very significant economic value. When it is detected that a portion of the injected fluid is being diverted to thief zones 12*b*, corrective action can be taken to prevent additional wastage.

The present invention can be utilized not only to determine the existence of fluid communication between two horizons, but also to determine the probable pathway by which the fluid communication is occurring. Where significant channeling is the cause of the fluid loss to a thief strata 12*b*, the transducer 24 proximate that strata 12*b* will respond very quickly, generally within a matter of seconds or minutes. However, where the fluid loss to the thief strata 12*b* is due to communication through fractures joining the perforated strata 12*a* and the thief strata 12*b*, the response will generally be somewhat delayed. Thus, time response in any detected fluid communication can be utilized in the interpretation of the results obtained from the practice of this invention. To facilitate the interpretation of the data obtained and to improve the response time, it is generally preferable to position the transducer 24 in a portion of the potential thief strata 12*b* nearest the perforated interval 12*c* into which injection is occurring.

The use of multiple pressure transducers 24 above and below the perforated interval is useful for providing data concerning the extent of a fracture or channel. For example, suppose that it was decided to monitor a well for which it was believed that there was extensive fracturing of the strata surrounding the borehole at locations above the interval to be perforated. Pressure transducers A-M could be sequentially situated at each of the permeable intervals above the interval to be perforated. Where only transducers A-G are found to be sensitive to the injection of fluid into the perforated interval, then the mechanism for fluid communication, either fractures or channeling, terminates at a portion of the well corresponding to the interval between transducers G and H.

In another application, the present invention can be utilized to determine the existence of fluid communication through the annulus 18 between a first stratum which is to be perforated and one or more other strata, in the absence of any fluid injection. To achieve this, pressure transducers 24 are positioned at points in the annulus 18 above and below the first stratum. The pressure in the casing 16 is then brought to a magnitude other than that of the first stratum, preferably to a pressure lower than that of the first stratum. The first stratum is then perforated while the transducers 24 at the other strata are monitored. A drop in the pressure observed at any of the transducers 24 within several minutes of perforation is indicative of channeling through the cement between the perforated interval and the monitored interval.

This technique has been practiced with success. A well was drilled and cased having suspected oil zones extending from about 6,595 feet to 6,640 feet. Pressure transducers were positioned above and below this horizon at 6,585 feet and 6,659 feet. An interval from 6,611 feet to 6,619 feet was to be perforated. The output of the sensors 24 was constant prior to the well being perforated and the pressure in the casing 16 was brought to a level significantly below that of the interval to be perforated. Upon perforation, immediate pressure decreases were observed at the two sensors, showing that pressure communication existed between the perforations and each of the sensors 24. This immediate response is indicative of channeling existing intermediate the perforated interval and the pressure transducers at 6,585 feet and 6,659 feet. Other pressure transducers, situated farther from the perforations, showed no response upon perforation of the well. This indicates that a good cement seal existed at some point between these other pressure transducers and the perforated interval.

An additional use of this development is monitoring reservoir pressure with time to determine the effects of production. This technique is especially useful in establishing the extent of pressure depletion in gas or oil reservoirs in which pressure is reduced as fluid is produced. In the practice of this technique a transducer 24 is positioned in the cement adjacent the reservoir from which production is to occur. The output of this transducer 24 is monitored during production. It is especially useful in the practice of this technique to record displays of detected reservoir pressure as a function of time and as a function of production.

Figure 2:
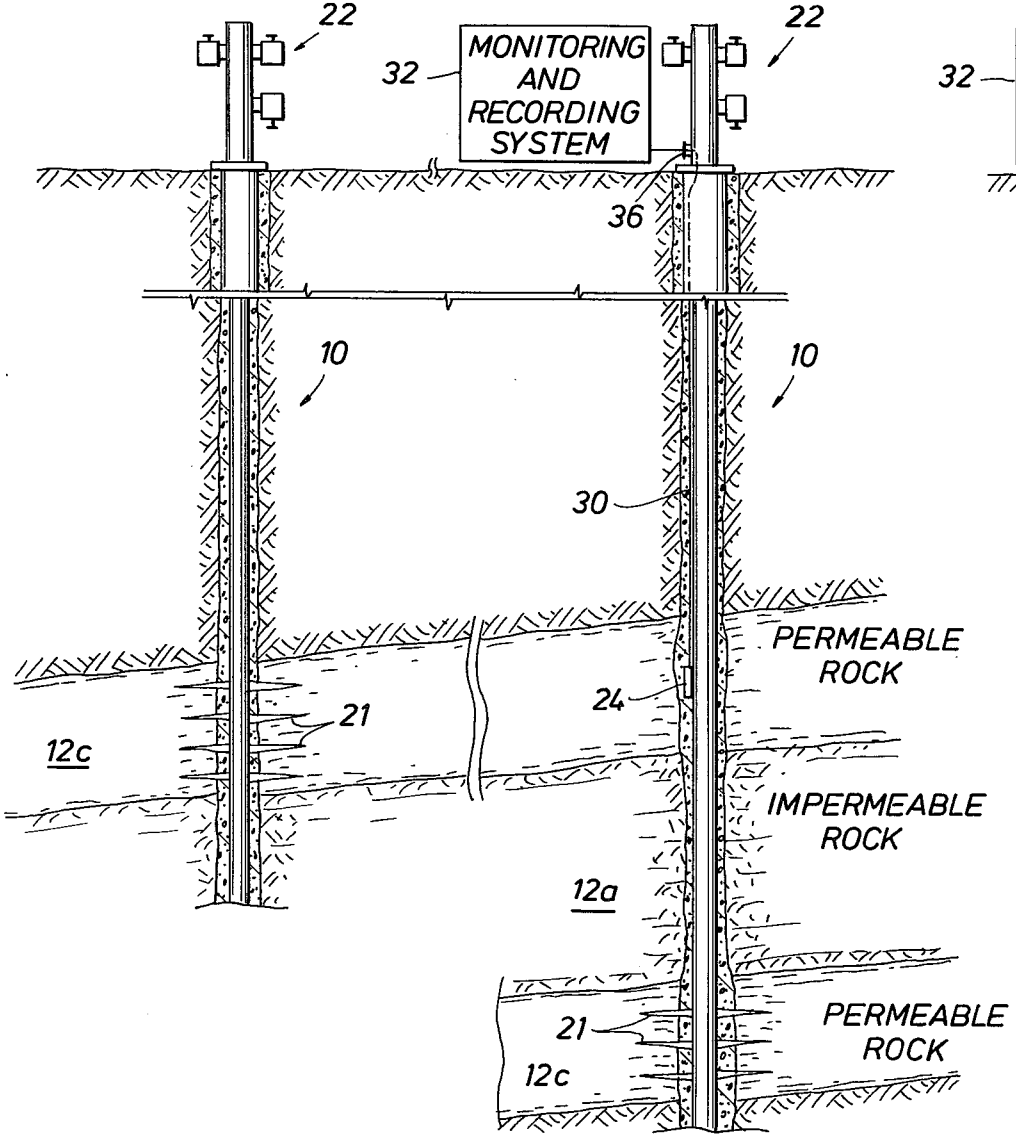
FIG. 2 shows a cross-sectional, diagrammatic view of two spaced apart wells incorporating apparatus adapted and positioned for practicing an alternative embodiment of the method of the present invention.

This invention is also useful in monitoring fluid communication through a horizon extending between two wells. As best shown in FIG. 2, a pressure transducer 24 is situated in the cemented annulus 18 at a position proximate the horizon of interest in one of the wells. The pressure of the horizon of interest at the point it is intersected by the other of the wells is altered, as by the injection or production of a fluid. The output of the pressure transducer 24 is monitored. Pressure transient theory is utilized to determine various features of the horizon of interest from the correlation between the pressure change at the point of injection and resulting pressure variations detected by the pressure transducer 24. The absence of any response at the pressure transducer 24 might be indicative of a total absence of fluid communication through the horizon between the wells caused, for example, by a fault passing through the horizon.

In addition to those applications set forth above, it should be realized that the techniques and methods taught herein have other advantageous features rendering them especially well adapted for other uses as will be apparent to those skilled in the art upon review of the present teachings and the appended claims. One of the most significant advantages of the methods for monitoring subterranean fluid communication and migration set forth herein is that fracturing, acidizing, waterflooding, production, perforation and virtually all other completion, production and workover operations may be carried on during monitoring operations. Further, the present method allows the pressure of unperforated intervals to be monitored. Additionally, unlike many "in-casing" monitoring systems and methods, the present techniques can be utilized irrespective of the existence of tubing and packers within the casing.

It should be appreciated that the use of temperature sensors in place of or in conjunction with the pressure sensors 24 can also yield data useful in determining the existence of fluid communication between strata. Temperature measurements are primarily useful in determining flow occurring through the annulus 18. This is because the passage of fluids between formations other than along the annulus 18 generally results an undetectably low aberation in the temperature gradient along the annulus 18. Thus, for example, the use of pressure and temperature transducers in conjunction can provide data allowing an improved analysis of the path by which fluid flow occurs.

What is claimed is:

1. A method for completing and monitoring a well which traverses a series of rock strata, to obtain data useful in the detection of flow away from a selected rock stratum traversed by said well of a portion of a fluid injected into said selected rock stratum, said method comprising the steps of:

attaching a first pressure transducer to the outer surface of casing adapted to be positioned within the borehole of said well, said pressure transducer being adapted to measure fluid pressure, the position of said first pressure transducer on said casing being controlled to ensure that upon said casing being fixedly positioned in said borehole, said first pressure transducer is positioned a spaced axial distance along said borehole away from said selected rock stratum;

setting said casing within said borehole;

cementing the annulus intermediate said casing and the face of said borehole, and allowing said cement to cure;

perforating said casing at the interval where said casing traverses said selected rock stratum;

injecting said fluid into said selected rock stratum through said perforations; and, monitoring the output of said transducer, an increase in the monitored pressure being indicative of flow of a portion of said fluid away from said first rock stratum.

2. The method as set forth in claim 1, wherein prior to setting said casing within said borehole there is further included the step of:

attaching a second pressure transducer to the outer surface of said casing, said second pressure transducer being adapted to measure fluid pressure, the position of said second pressure transducer being controlled to ensure that upon said casing being fixedly positioned in said borehole, said second pressure transducer is positioned a spaced axial distance along said borehole away from said selected rock stratum, said selected rock stratum being intermediate said first and second pressure transducers.

3. The method as set forth in claim 1, wherein said step of attaching said first pressure transducer includes the substep of:

locating said first pressure transducer on said casing to insure that upon said casing being fixedly positioned in said borehole, said first pressure transducer is proximate a permeable potential thief rock stratum separated from said selected rock stratum by at least one substantially impermeable rock stratum.

4. The method as set forth in claim 1, wherein said step of attaching said first pressure transducer includes the substep of:

locating said first pressure transducer on said casing to insure that upon said casing being fixedly positioned in said borehole, said first pressure transducer is proximate a substantially impermeable rock stratum.

5. The method as set forth in any of claims 1 through 4 further including the step of displaying the monitored pressure as a function of time whereby changes in monitored pressure are placed in visually perceptable form.

6. A method for obtaining data useful in detecting the existence of fluid communication between a first rock stratum and a second rock stratum, said first and second rock strata being traversed by a wellbore, said wellbore having casing extending substantially coaxially therewith between said first and second rock strata, said wellbore and said casing defining an annulus, said method comprising the steps of:

positioning a first fluid pressure transducer within said annulus at a location proximate said first rock stratum;

cementing at least that portion of said annulus proximate said first rock stratum, said first pressure transducer being sensitive to fluid pressure within said cement;

allowing said cement to cure;

altering the presence of the second rock stratum proximate the borehole; and, monitoring said first pressure transducer in response to the alteration of the pressure of said second rock stratum, whereby here can be established any correlation between the alteration of the pressure condition of said second rock stratum and the output of said first pressure transducer.

7. The method as set forth in claim 6, further including the step of monitoring the pressure at said second interval.

8. The method as set forth in claim 6, further including the steps of:

positioning a second fluid pressure transducer within said annulus at a location proximate said second rock stratum; and, monitoring said second pressure transducer.

9. The method as set forth in claim 7 or claim 8, further including the step of displaying the output of said first fluid transducer and the pressure at said second rock stratum whereby any correspondence between pressure changes at said first and second rock strata can be visually perceived.

10. The method as set forth in claim 6, wherein said first and second strata are separated by at least one intermediate stratum.

11. The method as set forth in claim 10, wherein said intermediate stratum is substantially impermeable.

12. A method for completing and monitoring a well to yield data useful in the detection of pore fluid transfer from a first permeable rock stratum to a second permeable rock stratum, said first and second rock strata being at different pressures and being a spaced axial distance apart along said well, said method comprising the steps of:

attaching a first and a second pressure transducer to the outside of casing adapted to be positioned within the wellbore of said well, said pressure transducers being positioned on said casing so that in response to said casing being fixed in said well, said first pressure transducer is proximate said first rock stratum and said second pressure transducer is proximate said second rock stratum;

positioning the casing within the wellbore;

cementing the annulus intermediate the face of said wellbore and said casing, said pressure transducers being adapted to monitor the fluid pressure within said cement; allowing said cement to cure;

monitoring said pressure transducers, whereby any change in the differential pressure between said first and second permeable rock strata may be observed.

13. The method as set forth in claim 12, further including the step of displaying the output of said pressure transducers.

14. A method for obtaining information useful in the interpretation of one or more conditions existing in a permeable rock stratum traversed by first and second laterally spaced wells, said method comprising the steps of:

affixing a fluid pressure sensitive transducer to the outer face of casing adapted to be positioned within said first well, said transducer being so positioned on said casing that in response to setting said casing in the wellbore of said first well, said transducer is proximate said permeable rock stratum;

cementing the region intermediate said wellbore and casing of said first well so that said transducer is at least partially blanketed by said cement, and allowing said cement to cure;

altering the pressure of said permeable rock stratum at a portion of said permeable rock stratum intersected by said second well; and, monitoring the output of said pressure transducer whereby any correspondence between the pressure change at said second well and the pressure detected by said pressure transducer may be determined.

15. The method as set forth in claim 14, further including the steps of:

monitoring the pressure of said permeable rock stratum at said second well; and, displaying the output of said pressure transducer and the pressure of said permeable rock stratum at said second well so that the output of said pressure transducer and the pressure of said permeable rock stratum at said second well can be visually compared.

16. A method for completing and monitoring a well to yield data useful in the detection of flow away from a selected rock stratum of a portion of a fluid injected into said rock stratum, said method comprising the steps of:

attaching a first pressure transducer to the outer surface of casing adapted to be positioned within the borehole of said well, said pressure transducer being adapted to measure fluid pressure, the position of said first pressure transducer on said casing being controlled to ensure that upon said casing being fixedly positioned in said borehole, said first pressure transducer is positioned proximate a permeable potential thief rock stratum separated from said selected rock stratum by at least one substantially impermeable rock stratum;

setting said casing within said borehole;

cementing the annulus intermediate said casing and the face of said borehole, and allowing said cement to cure;

perforating said casing at the interval where said casing traverses said selected rock stratum;

injecting said fluid into said selected rock stratum through said perforations; and, monitoring the output of said transducer, an increase in the monitored pressure being indicative of flow of a portion of said fluid away from said first rock stratum.

17. The method as set forth in claim 16, further including the step of displaying the monitored pressure as a function of time whereby changes in monitored pressure are placed in visually perceptable form.

* * * * *